US005224531A

United States Patent [19]

Blohm

[11] Patent Number: 5,224,531

[45] Date of Patent: Jul. 6, 1993

[54] PORTABLE SHOP/TOOLBOX

[76] Inventor: Erich Blohm, 464 Greenwich St., New York, N.Y. 10013

[21] Appl. No.: 774,509

[22] Filed: Oct. 10, 1991

[51] Int. Cl.[5] ..... B27H 1/12

[52] U.S. Cl. ..... 144/285; 108/78; 108/110; 108/115; 144/286 A; 144/287; 280/47.17; 280/47.2; 312/258; 312/249.12

[58] Field of Search ..... 144/285, 286 R, 286 A, 144/287; 269/244; 108/78, 90, 110, 111, 115; 280/47.17, 47.2; 312/250, 258

[56] References Cited

U.S. PATENT DOCUMENTS 4,209,045 6/1980 Bassett ..... 144/286 R
4,230,329 10/1986 Johnson ..... 144/286 A
4,369,822 1/1983 Rice ..... 144/286 R

FOREIGN PATENT DOCUMENTS 427500 4/1926 Fed. Rep. of Germany ..... 144/285
2575957 7/1986 France ..... 144/285

*Primary Examiner*—W. Donald Bray
*Attorney, Agent, or Firm*—Sprung Horn Kramer & Woods

[57] ABSTRACT

A portable apparatus for storing tools in an organized fashion and which also converts to a combination saw table, router table and workbench. The apparatus can be readily maneuvered, loaded into a truck bed and stored when folded. It also provides a rigid work surface with easy tool access when in the set-up position.

10 Claims, 5 Drawing Sheets

PORTABLE SHOP/TOOLBOX

BACKGROUND OF INVENTION

1. Field of the Invention

The present invention relates to a closed, compact, organized, easily maneuverable tool storage box which converts to a stable work bench equipped with a portable circular saw mount and router mount.

2. Description of Prior Art

Rolling tool storage cabinets have been used by mechanics for many years. Portable router tables have also existed for home handymen and professionals with limited space. Portable contractors table saws have also been produced for on-site accurate cutting. U.S. Pat. No. 3,615,087 (sold by Black & Decker as the "WORK-MATE") provides a portable work surface/clamping device. U.S. Pat. No. 4,281,570 discloses a portable circular saw mount with rip fence and cross cut guide to be used with WORK-MATE type clamping benches. U.S. Pat. No. 4,620,712 discloses a wheel mounted table saw which can be readily loaded onto a pick-up truck bed. U.S. Pat. No. 4,483,573 discloses a combination tool storage cabinet and tool mounting table. U.S. Pat. No. 4,281,843 discloses a portable, hand-truck like, open tool carrier. U.S. Pat. No. 3,010,775 discloses a closed, hand-truck like, equipment carrier with interior compartments. U.S. Pat. No. 2,004,296 discloses a wheel mounted folding table with storage drawers in the base. U.S. Pat. No. 4,369,822 discloses a combination tool chest dolly and leaved workbench. U.S. Pat. No. 4,478,467 discloses a portable workshop with folding storage cabinets and tool mounting surfaces.

None of the above cited inventions provides a combination closed, portable tool storage cabinet and stable work surface, with power tool mounts, in a compact form which is readily usable by contractors and home handymen.

SUMMARY OF THE INVENTION

One object of the invention is to provide easily portable, closed tool storage and a stable, usable work surface for field work in the building trades and for workshops with very limited space. The unit is designed for ease of loading by a single person into a van or pick-up truck, and for maneuvering, hand truck fashion, through doors and other narrow openings.

A second object is to provide a portable universal mounting table for hand-held power saws and routers. This mounting table is provided with movable rip and cross cut fences.

A third object is to provide a bench vise type clamping device that can also be used separately from the toolbox/workbench.

Another object is to make the toolbox/workbench fold up to be easily stored in an average closet while still providing access to the tools.

A further object is to provide maximum interior tool storage, organized to give ready access to all tools and equipment, and at the same time be adjustable to accept a large variety of tools required in various trades.

BRIEF DESCRIPTION OF THE DRAWINGS

The invention will be further described with reference to the accompanying drawings, wherein.

DESCRIPTION OF THE PREFERRED EMBODIMENT

Figure 1:
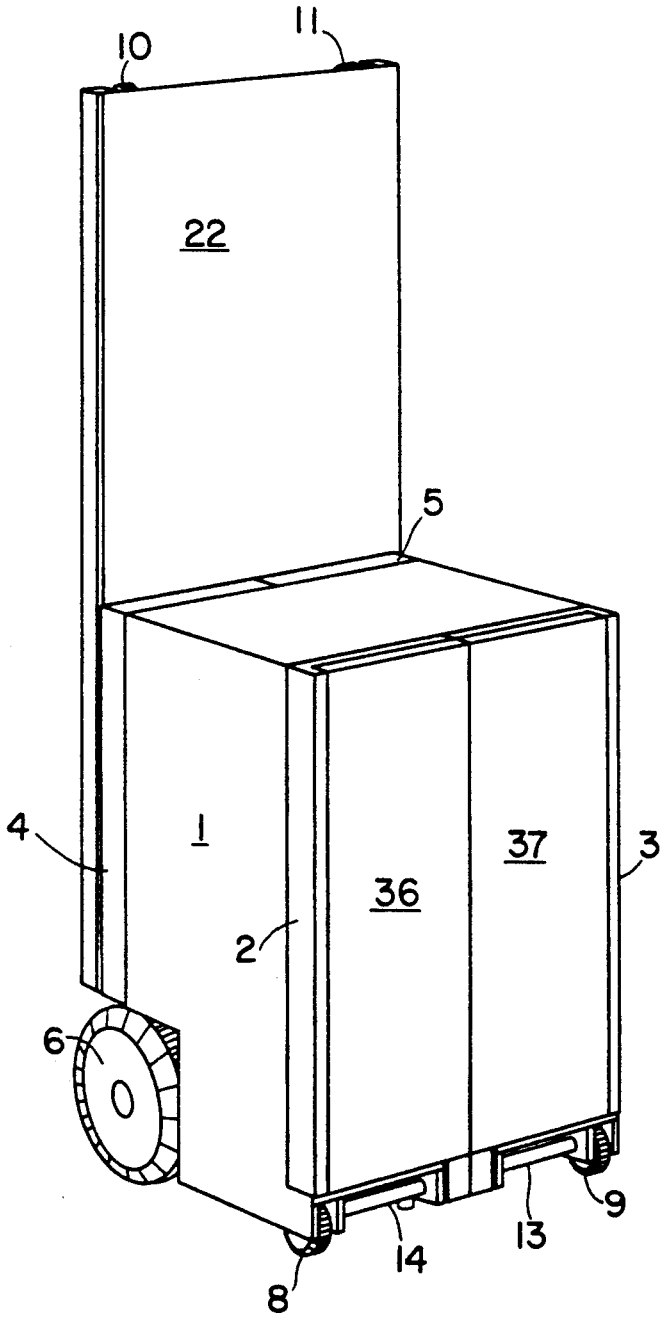
FIG. 1 is a perspective view of a portable shop/toolbox in accordance with the invention in the closed, portable position.

Referring now more particularly to the drawings, the present invention comprises a tool box 1 mounted on two large rear wheels (6, 7) and two smaller front wheels (8, 9). A removable top 22 is either mounted on the back of the box and used to support a handle 12 when the toolbox is in the closed position (FIG. 1), or mounted horizontally via quick fasteners on top of the box in the open position (FIG. 2). Wheels (10, 11) are mounted on the upper end of the top (in closed position) to facilitate easy loading of the toolbox into a van or pickup truck. Lower handles (13, 14) are supplied to aid in lifting the closed box onto a raised surface.

A portable saw/router mount 23, with cross cut guide slots (34, 35) is removably connected to the workbench surface (FIG. 2). A portable saw 24 (of a variety of models, readily available) is mounted upside down and used in table saw fashion. A rip fence 27 and variable angle cross cut guide 25 are provided for use with both the router and saw. A removable receptacle/-switch box 40 is provided to allow safe operation of the saw and router.

Drawers (15, 16, 17, 18, 19) are provided for tool and parts storage, and are fully removable to allow taking tools, parts, fasteners, etc. closer to a particular work area. Finger holes are provided to allow opening of the drawers. A large, open storage space, is provided between the drawers and base 39 for storage of extension cords, battery chargers, and other large objects. A space is provided at the rear of the toolbox interior to store the removable saw/router mount extension.

Figure 4:
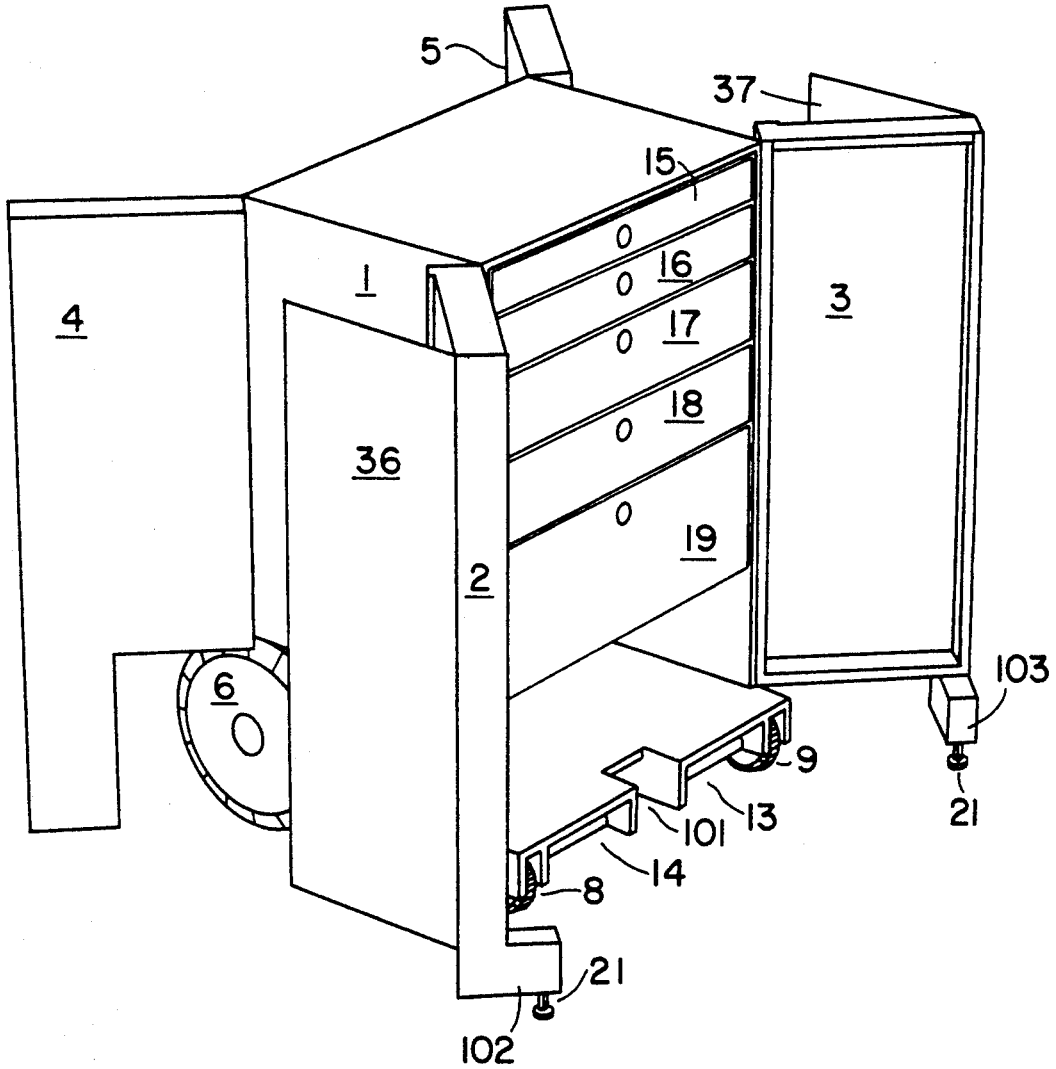
FIG. 4 is a front perspective view of the toolbox partially open with the top removed.

The base 39 is provided in its front and back center with two indents 101, only the front indent being seen in FIGS. 2 and 4.

Front doors (2, 3) and rear doors (4, 5), provided for closing and locking the tool compartment when in the closed position, are folded out and used for legs in the open position. Levelers 21 are provided to stabilize the legs on uneven surfaces.

Figure 5:
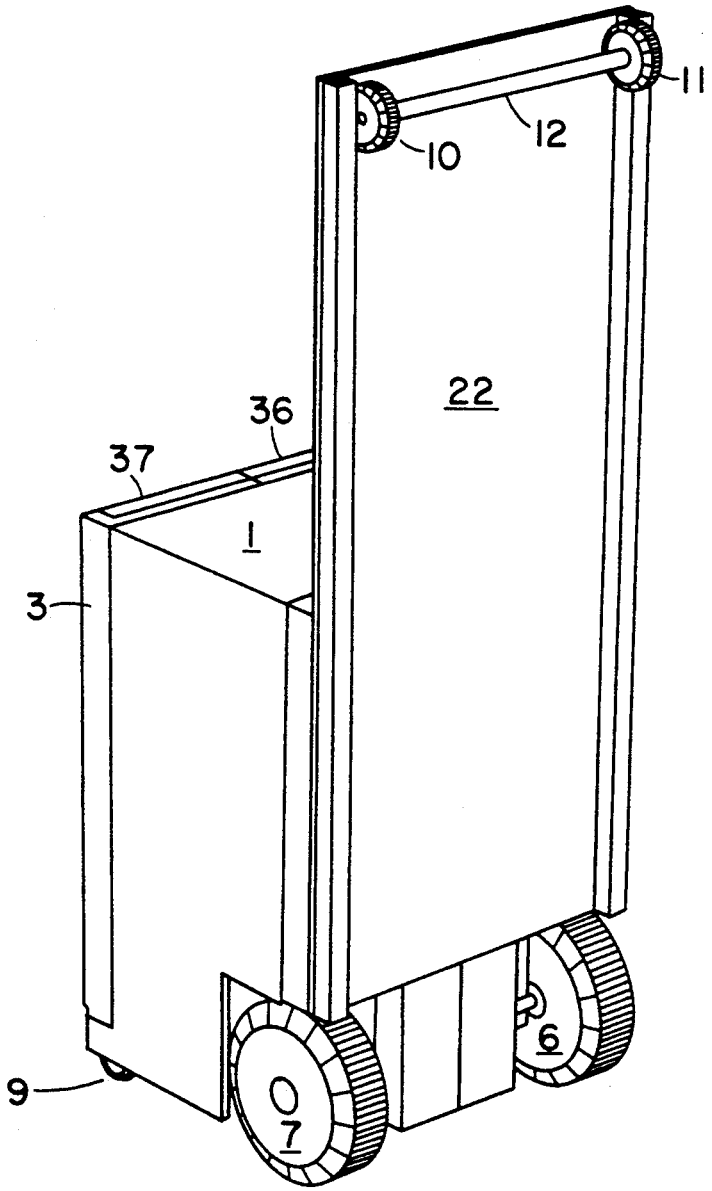
FIG. 5 is a rear perspective view of the toolbox in the closed position.

The doors 2 and 4 are hinged to side panel 41 (FIGS. 1 and 4) and doors 3 and 5 to side panel 42 (FIG. 5). Across their tops side panels 41 and 42 are connected by surface 43 (FIGS. 1, 4 and 5).

The insides of the doors are indented, the cavity facing inward during storage, and are used for tool storage with the addition of adjustable tool holders (28, 29, 30, 31, 32, 33,).

Stabilizing supports (36,37) are provided to hold the doors/legs rigid in the open position. These fold into pockets on the front doors when in the closed position, i.e. the stabilizing supports 36, 37 are hinged respectively to the main panels of doors 2, 3, the hinge lines being the center line in FIG. 1 and being apparent in FIG. 4.

Figure 2:
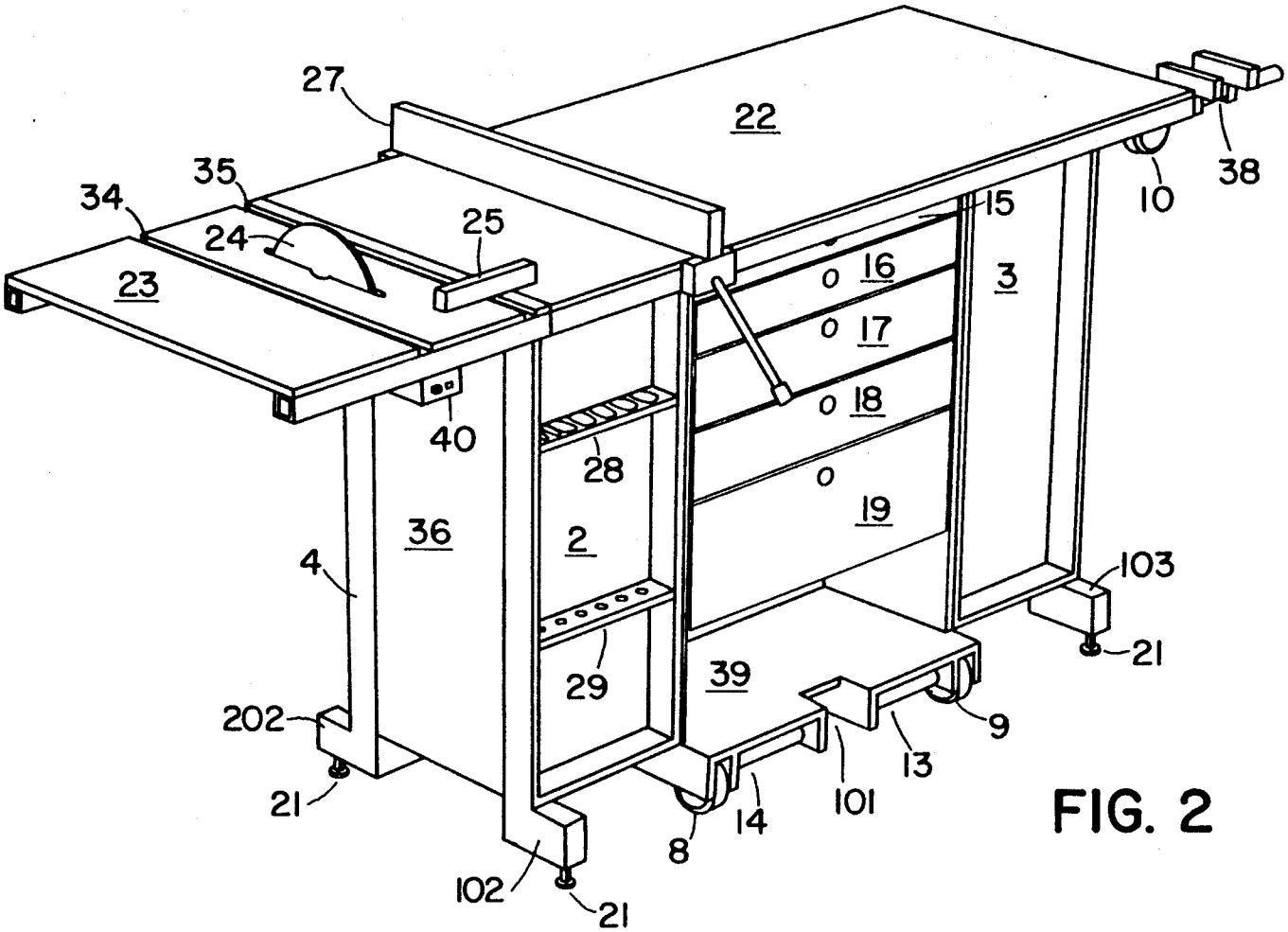
FIG. 2 is a front perspective view of the toolbox in the open, workbench/power tool table position.
Figure 3:
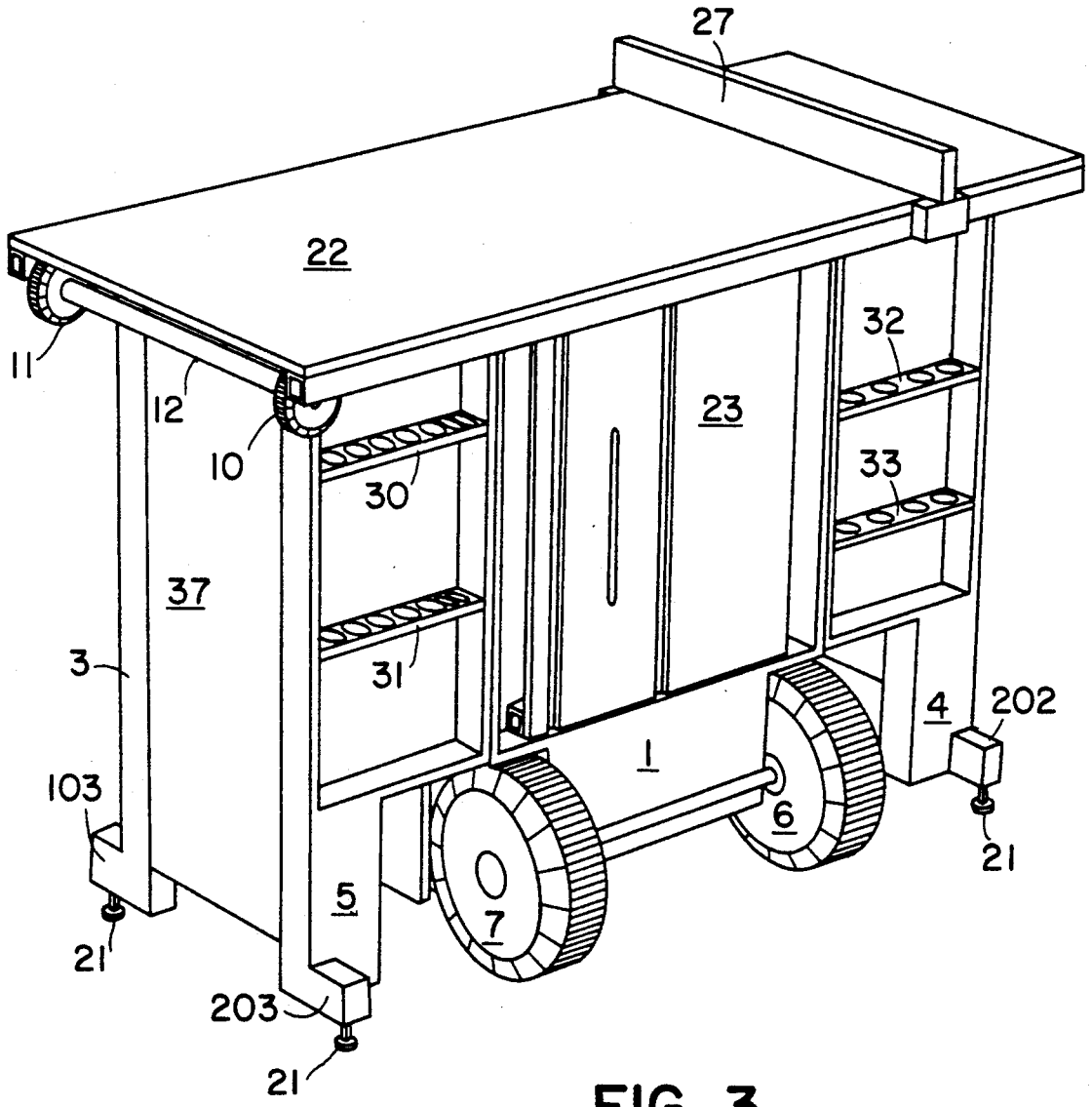
FIG. 3 is a rear perspective view of the toolbox in the open position.

Means (not shown) may be provided to secure the supports and main panels in the closed position of FIG. 1 and in the open position of FIGS. 2 and 3.

As seen in FIGS. 2, 3 and 4, the main panels 2 and 3 at their bottoms are provided with detents 102, 103, respectively, which in closed position enter into indent 101. Similar detents 202, 203 are provided on rear doors 4, 5 (FIG. 3) to enter into the detent on the indent on the rear of the structure (not shown).

A slide-in clamp/vise 38 provides a means to clamp work to the bench top or to be used to clamp pieces together, separate from the workbench.

It will be appreciated that the instant specification and examples are set forth by way of illustration and not limitation, and that various modifications and changes may be made without departing from the spirit and scope of the present invention.

I claim:

1. A toolbox which can be opened to an approximately waist-high work bench, comprising a pair of upstanding side panels spaced from one another, each of said side panels having a front edge and a rear edge, four door halves respectively hinged to the front and rear edges of each of said side panels, the front door halves and the rear door halves respectively engaging one another in the closed position of the toolbox, and means for engaging the door halves of each side panel to one another in the open position to form with the tops of said side panels an enlarged top support for the work bench.

2. A toolbox according to claim 1, having a closed top and a base extending horizontally between the side walls, at least one indent being provided in one of the horizontally extending members, the respective door halves being provided with detents which in closed position mate with the indent.

3. A toolbox according to claim 1, including wheels for transport, said wheels being operatively connected to said side panels and projecting therebelow in transport.

4. A toolbox according to claim 3, including a second set of wheels operatively connected to said side panels, so that said box is supported by both sets of wheels.

5. In combination, a toolbox according to claim 3, and a work surface top removably connected with the box and a third pair of wheels on said top work surface.

6. In combination, a toolbox according to claim 1, a top work surface removably connected with said box to form an approximately waist-high extension of said workbench and a saw removably connected with said work surface.

7. A combination according to claim 6, wherein said box is provided with interior compartments conforming in size and shape to said work surface and said saw.

8. A toolbox according to claim 1, including hand grips on said box for lifting thereof.

9. A toolbox according to claim 1, including means on the bottom of said doors for leveling said doors relative to a supporting surface.

10. A toolbox according to claim 1, wherein each door is indented in the surface which in closed position is inside, each door being provided with means for holding tools so that they remain in place during transport.

* * * * *